US007395764B2

(12) United States Patent
Debrunner

(10) Patent No.: US 7,395,764 B2
(45) Date of Patent: Jul. 8, 2008

(54) ASSIST APPARATUS AND METHOD

(76) Inventor: Daniel E. Debrunner, 6892 Meadowdale Cir., Cincinnati, OH (US) 45243

( * ) Notice: Subject to any disclaimer, the term of this patent is extended or adjusted under 35 U.S.C. 154(b) by 306 days.

(21) Appl. No.: 11/387,375

(22) Filed: Mar. 23, 2006

(65) Prior Publication Data

US 2006/0243112 A1 Nov. 2, 2006

Related U.S. Application Data

(60) Provisional application No. 60/665,665, filed on Mar. 28, 2005.

(51) Int. Cl.
*B61B 3/00* (2006.01)

(52) U.S. Cl. ..... 104/89; 105/29.1; 187/201

(58) Field of Classification Search ..... 104/62, 104/89, 91, 93, 94; 105/29.1, 148, 153; 187/200, 187/201, 245

See application file for complete search history.

(56) References Cited

U.S. PATENT DOCUMENTS 3,985,082 A * 10/1976 Barac ..... 104/89
5,230,405 A * 7/1993 Bartelt ..... 187/201
5,269,227 A * 12/1993 Warren et al. ..... 105/29.1
5,363,771 A * 11/1994 Warren et al. ..... 105/29.1
5,522,322 A * 6/1996 Warren et al. ..... 105/29.1
5,533,594 A * 7/1996 Tremblay et al. ..... 187/201
7,210,563 B2 * 5/2007 Vroegindeweij ..... 187/201

* cited by examiner

*Primary Examiner*—Lars A Olson
(74) *Attorney, Agent, or Firm*—Ronald J. Richter; Hasse & Nesbitt LLC

(57) ABSTRACT

An apparatus for assisting an elderly or physically limited individual in walking or carrying items up or down a stairway includes a guide rail assembly fixedly positioned along the wall of a stairway. A handle is connected to a support bar assembly, and the support bar assembly attaches to the guide rail assembly. The guide rail assembly typically has a tubular inner rail fixedly housed within a tubular outer rail, the outer rail typically includes a guide track along its length, and the inner rail typically includes a pin slot which aligns with the guide track. To operate the apparatus, the user grasps the handle while supporting the upper body on the support bar and moves the support bar assembly along the guide track while walking along the stairway. The handle and support bar assembly can be placed into a braking position as needed while moving along the stairway. The apparatus is adaptable to any home, can help stabilize someone who has difficulty walking, and can provide assistance for carrying items such as laundry or groceries up or down the stairs.

22 Claims, 8 Drawing Sheets

ASSIST APPARATUS AND METHOD

CROSS-REFERENCE TO RELATED APPLICATION

This application claims the benefit of U.S. Provisional Application No. 60/665,665, filed on Mar. 28, 2005.

FIELD OF THE INVENTION

This invention relates to an apparatus and method for aiding a person needing assistance to travel or to carry items up and down a stairway.

BACKGROUND OF THE INVENTION

Falls, slips and trips are the most common type of accident and injury in the home. For elderly and physically limited persons, even minor falls can lead to a fear of falling again, and a tendency towards reducing physical activity. Such individuals also typically live in private homes, and are typically confined to one story of such homes except for relatively rare occasions when one or more persons are available to help them up or down the stairs to another story. In much too large a number of cases, this results in the older or other disadvantaged person living out a very major portion of his or her life on an upper story without substantial meaningful contact with people other than the immediate family.

Numerous devices exist in the prior art which provide structures to aid persons with walking disabilities or difficulties to traverse stairways. For example, U.S. Pat. No. 4,253,287 to Overmoe discloses a walking bar for aiding persons to climb or descend stairs which can be moved along a stairway one step at a time. The Overmoe apparatus includes a pair of guide railings at opposing sides of a stairway, each with a guide slot, and a walking bar which fits into the guide slots for the user to hold onto. One of the distinguishing features of the Overmoe apparatus is that the path made by the guide slots are typically arched in shape and lead to ratchet tooth holding sections in which the walking bar sits at the conclusion of each step. With this arrangement, it is difficult for the user to move more than a single step at a time without stopping their movement, readjusting their grip and their stance, lifting the bar out of the holding section, over the next arch and into the next holding section, and moving to the next step. It would therefore be beneficial to provide a device which can easily be moved in a straight line along the entire length of a stairway by a user.

U.S. Pat. No. 5,269,227 to Warren discloses a motorized, portable, upper body support device which can be used transferably with a virtually unlimited number of different stairways. Both Warren and Overmoe require the user to attach and detach the support device before and after each use, and to remember to carry the support device around with them from stairway to stairway. Further, the Warren support includes a motor which is not small or light in weight. It would therefore be beneficial to provide a light weight apparatus that can bear substantially the entire weight of the user while climbing and descending stairways, and that can be placed in a vertical position to the side of the stairway when not in use, without having to detach the support bar from the guide rail.

SUMMARY OF THE INVENTION

Accordingly, the invention provides an apparatus for assisting a person in walking up or down a stairway which can bear substantially the entire weight of the user. The apparatus is typically operated while disposed in a horizontal position across the stairway, but it can be folded and neatly placed in a vertical position to the side of the stairway when not in use, without having to detach the support bar from the guide rail. Further, the apparatus is light in weight and can easily be moved in a straight line along the entire length of a stairway by a user climbing or descending a stairway. The apparatus can also assist someone who is carrying something such as laundry or groceries up and down stairs, and is adaptable to any home.

A first aspect of the invention relates to an apparatus for assisting a user in walking or carrying items up or down a stairway, the apparatus comprising (a) a guide rail assembly fixedly positioned along the wall of a stairway and comprising a tubular inner rail fixedly housed within a tubular outer rail, the outer rail including a guide track formed along the length thereof, the inner rail including a pin slot configured to align with the guide track; (b) a support bar assembly configured to be supported by the inner rail and freely moveable along the length of the pin slot, the support bar assembly operable to be placed into a braking position by the user; and (c) a handle adapted to be grasped by the user, wherein the handle is rotatably connected to the support bar assembly.

A second aspect of the invention relates to an apparatus for assisting a user in walking or carrying items up or down a stairway, the apparatus comprising (a) a guide rail assembly fixedly positioned along the wall of a stairway and comprising a tubular inner rail fixedly housed within a tubular outer rail, the outer rail including a guide track formed along the length thereof, the inner rail including a brake track, a thrust track, and a pin slot configured to align with the guide track of the outer rail; (b) a support bar assembly configured to be supported by the inner rail and freely moveable along the length of the pin slot, the support bar assembly operable to be placed into a braking position by the user and comprising a pin assembly, a hinge, and a casing, the pin assembly comprising (i) at least one wheel comprising an orifice and configured to rotatably move along the thrust track; (ii) a brake plate configured to slidably move within the brake track and operable to pivot to a braking position within the brake track; and (iii) an elongated pin comprising a proximal end affixed to the brake plate and a distal end affixed to the hinge and the support bar casing, the pin extending through the guide track, the pin slot and the orifice of each wheel; and (c) a handle adapted to be grasped by the user, wherein the handle is rotatably connected to the support bar casing.

In one embodiment, the handle comprises side bars adapted to secure a carrying device, the side bars including lumens and the carrying device including tabs configured to fit within the lumens.

In another embodiment, the brake track comprises a gear track, and the brake plate comprises gears configured to engage the gear track, wherein pivoting of the brake plate causes the gears to engage the gear track and place the support bar assembly into the braking position. In this embodiment, pivoting is caused by the user pushing down on the handle.

In another embodiment, the brake track comprises top and bottom elastomeric strips, and the brake plate comprises an elliptical plate configured to pivot within the brake track, wherein pivoting of the elliptical plate reversibly wedges the brake plate between the elastomeric strips and places the support bar assembly into the braking position. In this embodiment, pivoting is caused by the user pushing down on or pulling up on the handle.

In another embodiment, the guide rail assembly is a first guide rail assembly and the apparatus also has a second guide rail assembly identical to and fixedly positioned along the wall below the level of the first guide rail assembly, wherein the support bar assembly comprises a lever means adapted to reversibly adjust the height of the support bar assembly between the height of the first guide rail assembly and the height of the second guide rail assembly.

In another embodiment, the guide rail assembly is a first guide rail assembly and the apparatus also has a second guide rail assembly comprising a second outer rail fixedly positioned directly across the stairway from the first guide rail assembly, wherein the support bar assembly is configured to be supported by both guide rail assemblies A further understanding of the nature and advantages of the invention will be more fully appreciated with respect to the following drawings and detailed description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

As used herein, the term "braking position" refers to a position of the support bar assembly in which free movement of the support bar assembly along the guide rail assembly is reversibly stopped.

Figure 1:
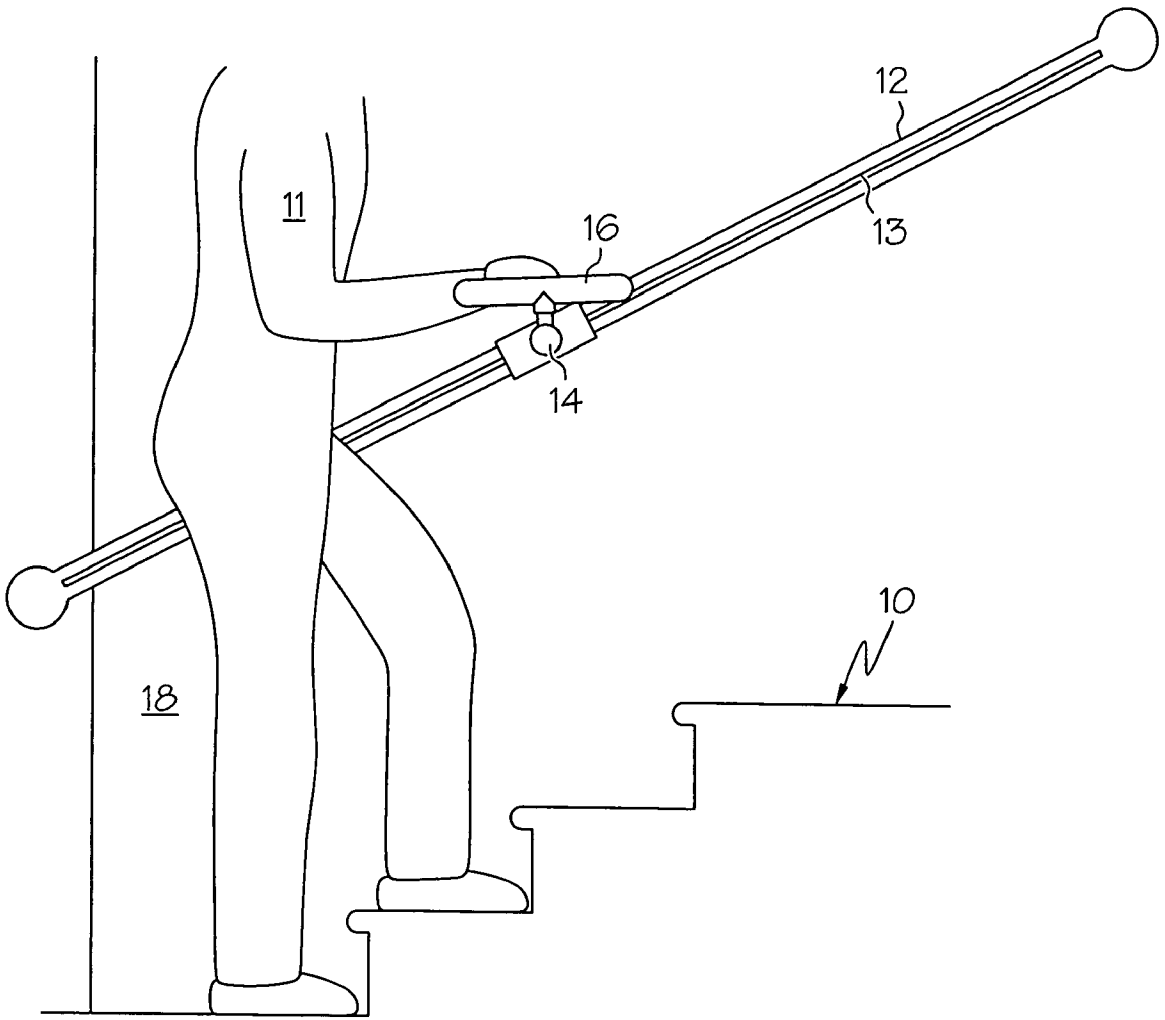
FIG. 1 is a perspective view of a stairway showing a user grasping the handle of the apparatus of the invention. A wall with a guide rail mounted thereon and a support bar and handle of the invention positioned with respect to the guide rail.

As illustrated in FIG. 1, the apparatus of the invention can easily be moved in a straight line along the entire length of a stairway 10 by a user 11 climbing or descending the stairway. The stairway 10 typically extends upwardly and downwardly along a slope with respect to horizontal, and has vertically-spaced and horizontally-offset steps for climbing. The apparatus includes an elongated, tubular guide rail 12 as part of a guide rail assembly which is securely mounted to a wall 18 generally parallel to the angle of the stairway 10. The outer guide rail 12 includes a guide track 13 formed along its length. A support bar assembly 14 is movably secured to the guide rail assembly and is generally freely slideable along the length of the guide track 13. The handle 16 is connected to the support bar assembly 14, which the user 11 grasps for assistance in moving up and down the stairway 10.

Figure 2:
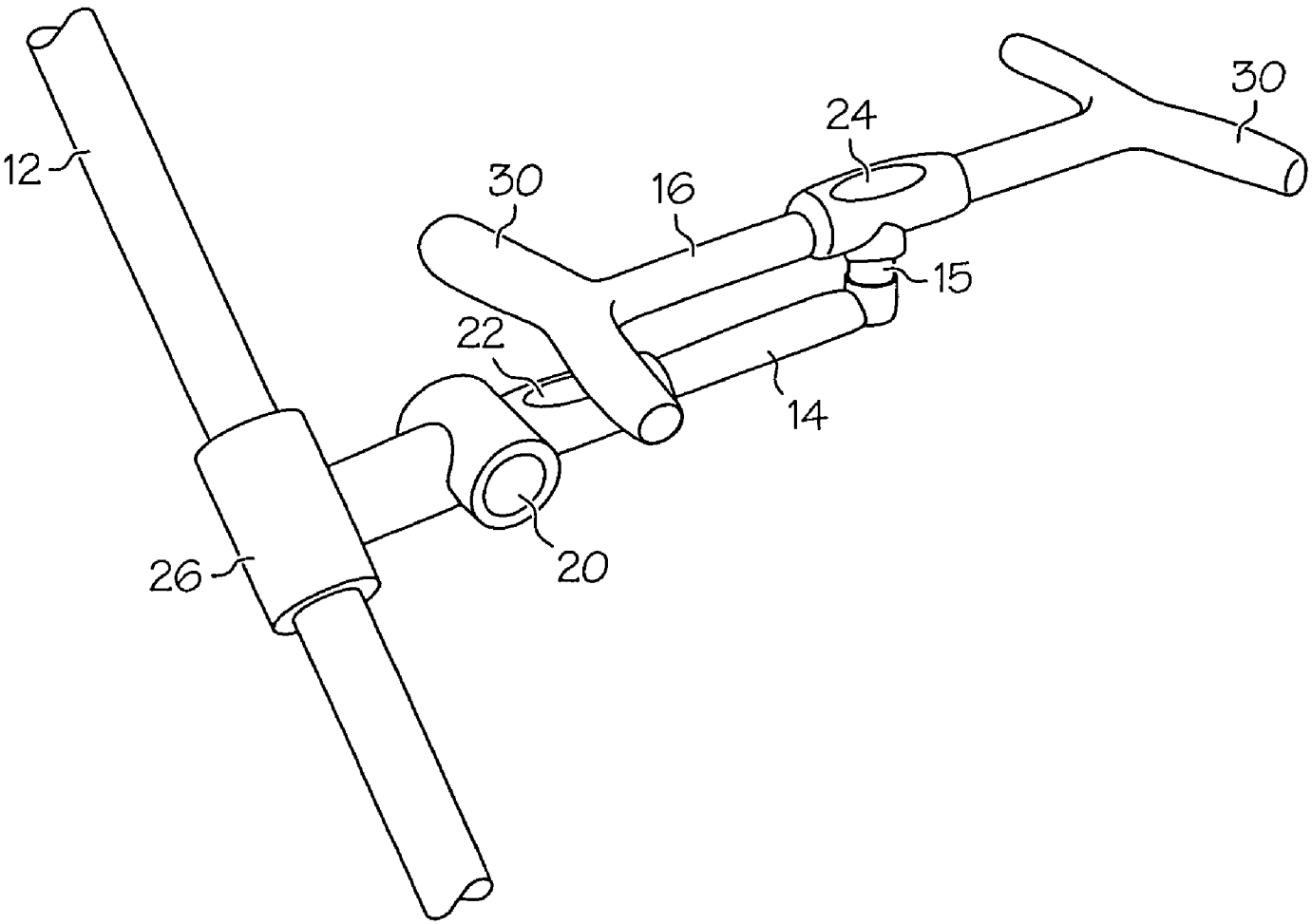
FIG. 2 is a perspective view of one embodiment of the apparatus of the invention with the support bar in a horizontal position.

FIG. 2 illustrates one embodiment of the invention in which the outer tubular rail 12 of the guide rail assembly supports the support bar assembly 14, and the handle 16 is rotatably attached by connector 15 to the casing of the support bar assembly 14. Handle control button 24 allows the user to lock and unlock the handle 16 so that it can be rotated, and handle grips or side bars 30 are located at either end of the handle 16. The casing of the support bar assembly 14 is affixed to a hinge 20, which is operable to be locked and unlocked by activation of a hinge control button 22. The casing 14 also includes a sleeve 26 which slidably fits around the rail 12. Although not shown, the sleeve 26 typically does not completely circumvent the rail 12, but rather leaves room to slide past attachment posts connecting the rail 12 to the wall.

Figure 3:
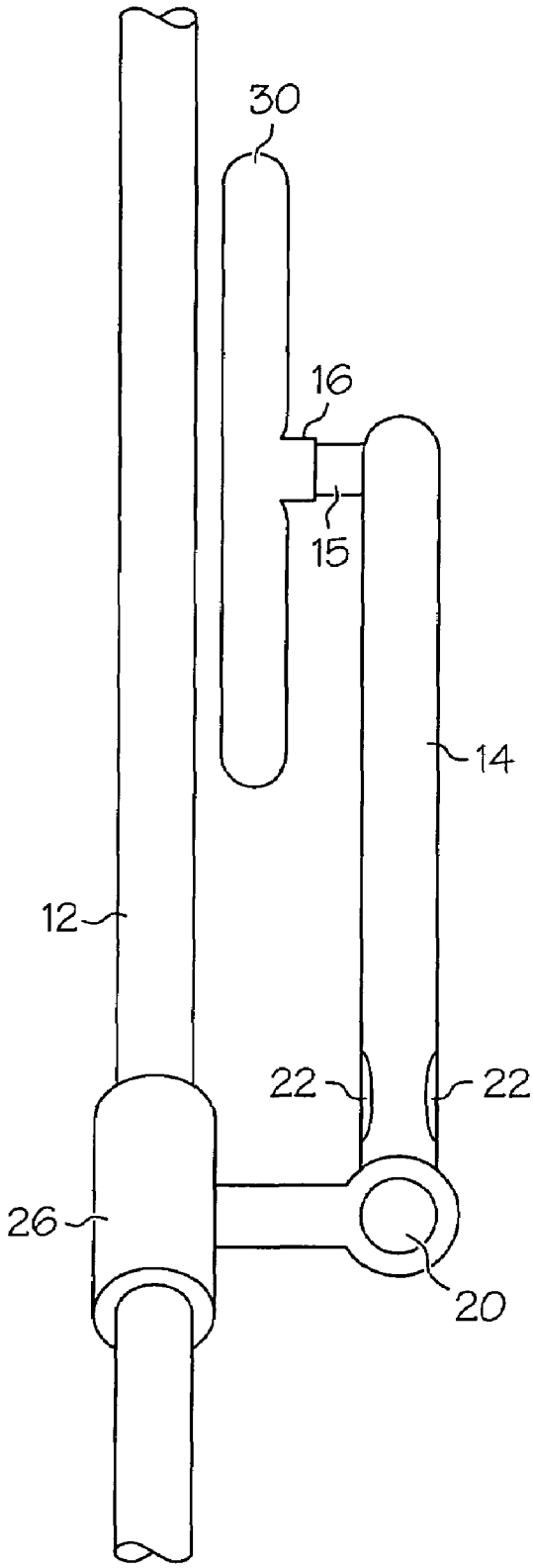
FIG. 3 is a frontal view of the apparatus of FIG. 2 with the support bar in a vertical position.

FIG. 3 shows the apparatus of FIG. 2 folded at the hinge 20, so that the support bar assembly 14 is in a vertical position along the rail 12. The hinge control button 22 is typically reachable on either side of the casing 14 of the support bar assembly, so that the user has easy access thereto whether the support bar 14 is in the vertical or horizontal position. Typically the hinge 20 is in a locked position when the hinge control button 22 is not being pressed, and switches to an unlocked position upon activation of the button 22 by the user, so that once the apparatus is placed in either the vertical or horizontal position, the hinge 20 locks it in that position. As illustrated, the handle 16 and handle side bars 30, connected to the support bar assembly 14 by connector 15, are typically placed into a vertical position when not in use, keeping the apparatus to the side of the stairway, and also out of the way of others who do not require the apparatus to climb the stairs.

Figure 4:
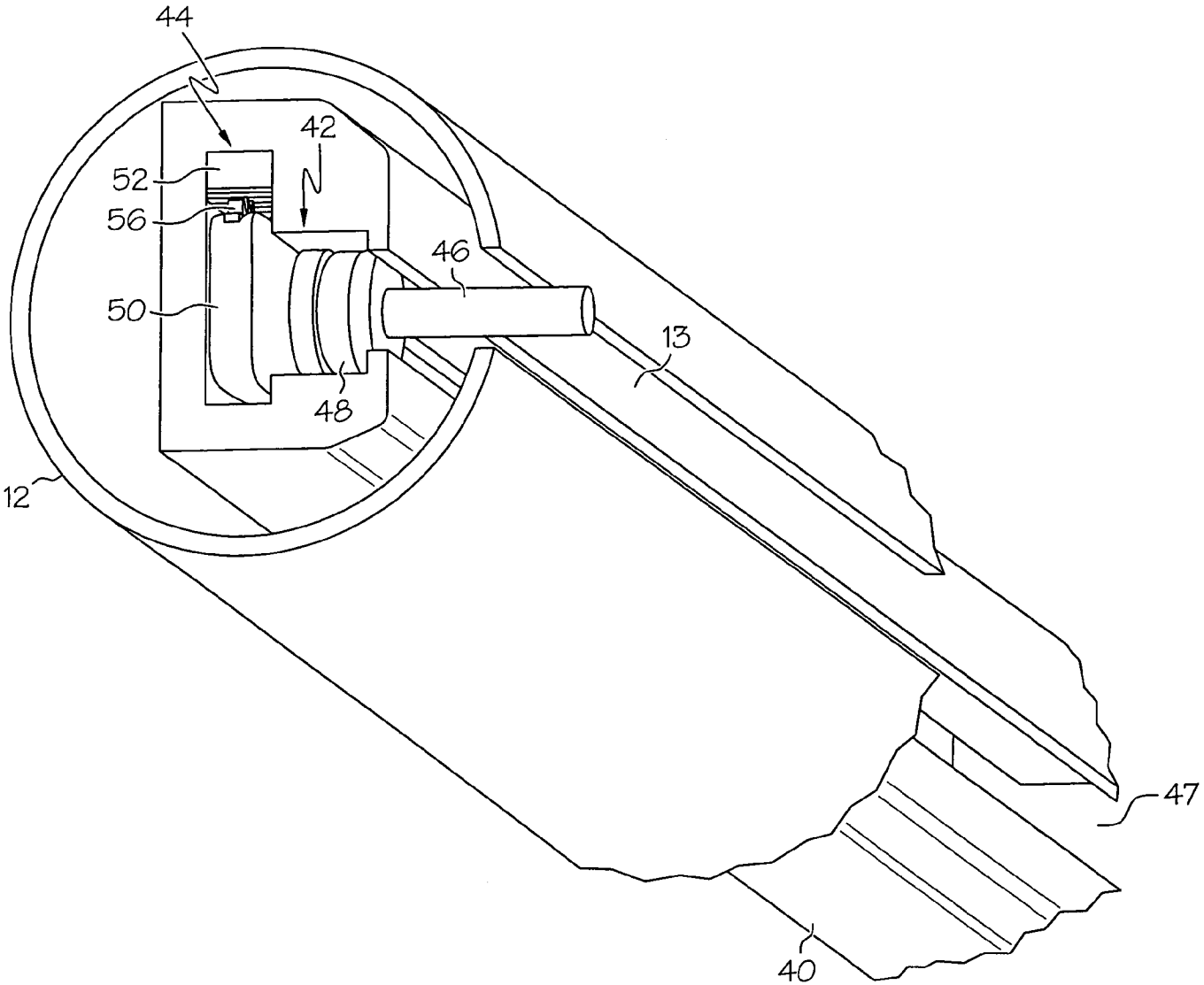
FIG. 4 is an enlarged fragmentary view of the internal rail of one embodiment of the guide rail assembly of the invention.

FIG. 4 is an enlarged fragmentary view of the guide rail assembly of the invention, illustrating a tubular internal rail 40 within the tubular outer rail 12. In this embodiment, the inner rail 40 includes a thrust track 42 and a brake track 44. An elongated pin 46 extends through a pin slot 47 that aligns with the guide track 13 of the outer rail 12. The pin 46 also freely extends through an orifice of the wheels 48, and the distal end of the pin 46 is affixed to a brake plate 50. As the pin 46 is moved along the pin slot 47, the wheels 48 freely rotate about the pin slot 47 and roll along the thrust track 42. The brake plate 50, affixed to the distal end of the pin 46, moves with the pin 46 as the pin moves along the pin slot 47. In addition, the brake plate 50 is pivotable within the brake track 44. For example, in this embodiment the brake track 44 includes a gear track 52, and the brake plate has gears 57 which can engage the gear track 52. When the brake plate 50 pivots within the brake track 44, the gears 57 engage the gear track 52 and place the pin 46 of the support bar assembly into a braking position, in which free movement of the support bar assembly along the guide rail assembly is reversibly stopped.

Figure 5:
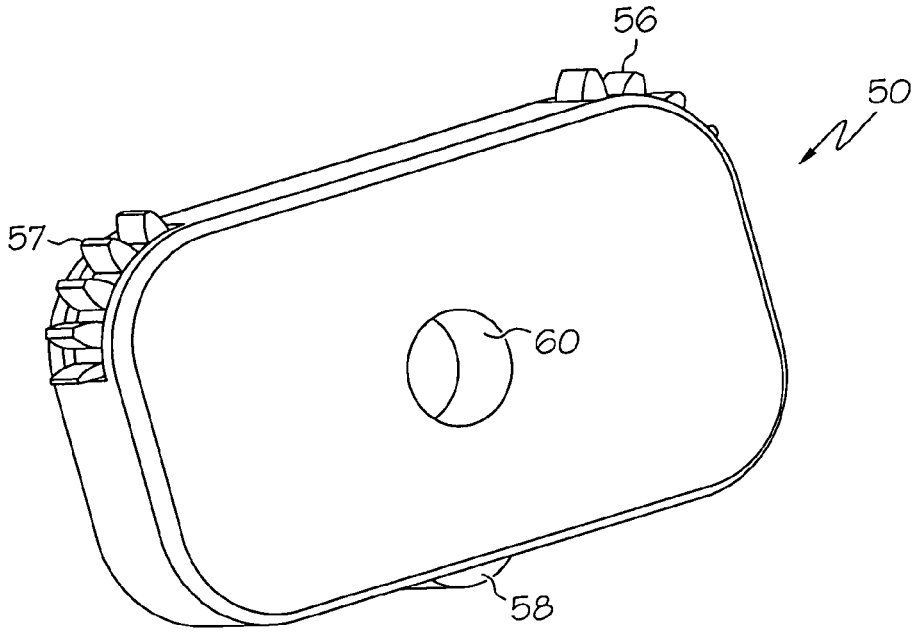
FIG. 5 is a perspective view of one embodiment of a brake plate of the invention.

FIG. 5 illustrates the brake plate 50 of FIG. 4, comprising gears 56, 57 at either end of the brake plate and a nub 58 defining the central bottom portion thereof. Contact between the nub 58 and the brake track 44 typically causes the brake plate 50 to pivot within the brake track 44. The brake plate 50 also comprises a central orifice or hole 60 for the distal end of the pin 46 (FIG. 4) of the support bar assembly 14 to fit into. The fit of the pin 46 and the central hole 60 is typically a frictional fit, so that when the distal end of the pin 46 is caused to rotate or to move a certain distance from the horizontal plane of the brake track 44, brake plate 50 also moves. When the brake plate 50 is caused to rotate, the gears 56, 57 engage the gear track 52. Typically this occurs when the brake plate 50 is caused to pivot between about seven degrees to about ten degrees from the horizontal plane of the brake track 44, and typically this movement is brought about when the user pushes down or pulls up on the handle for support.

Figure 6:
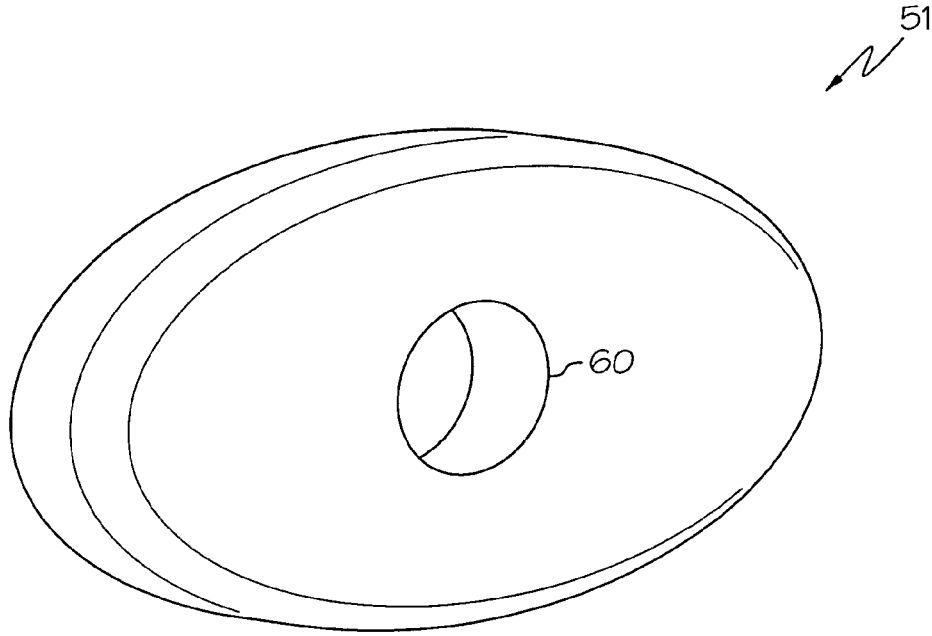
FIG. 6 is a perspective view of another embodiment of a brake plate of the invention.

FIG. 6 illustrates an alternative embodiment of the brake plate as an elliptical plate 51 with a central hole 60. Like plate 50, the distal end of pin 46 frictionally fits within the central hole 60 of the elliptical plate 51. Looking at FIG. 7, the pin 46 freely passes through the pin slot 47 and wheels 48, and the distal end of the pin 46 is frictionally affixed within the central hole of the brake plate 51. The wheels 48 and the plate 51 are freely moveable along the thrust track 42 as the user moves the pin 46 along the pin slot 47. The brake plate 51 is typically moveable within the brake track 44 and moves together with the wheels 48 and the pin 46 along the length of the pin slot 47. However, as described above, the brake plate 51 is also pivotable within the brake track 44 and can bring the support bar assembly to a braking position. For example, in this embodiment there are elastomeric strips 54, 55 included at the top and bottom of the brake track 44. The elliptical plate 51 can be caused to reversibly wedge between the elastomeric strips 54, 55, typically when the user pushes down or pulls up on the handle for support. Thus, when the user supports their upper body on the handle and support bar, the pin 46 and also the brake plate 51 are caused to rotate or to move a certain distance from the horizontal plane of the brake track 44, causing the brake plate 51 to become reversibly wedged between the elastomeric strips 54, 55, and placing the support bar assembly into the braking position. Typically this occurs when the brake plate 51 pivots between about seven degrees to about ten degrees within the horizontal plane of the brake track 44.

Figure 7:
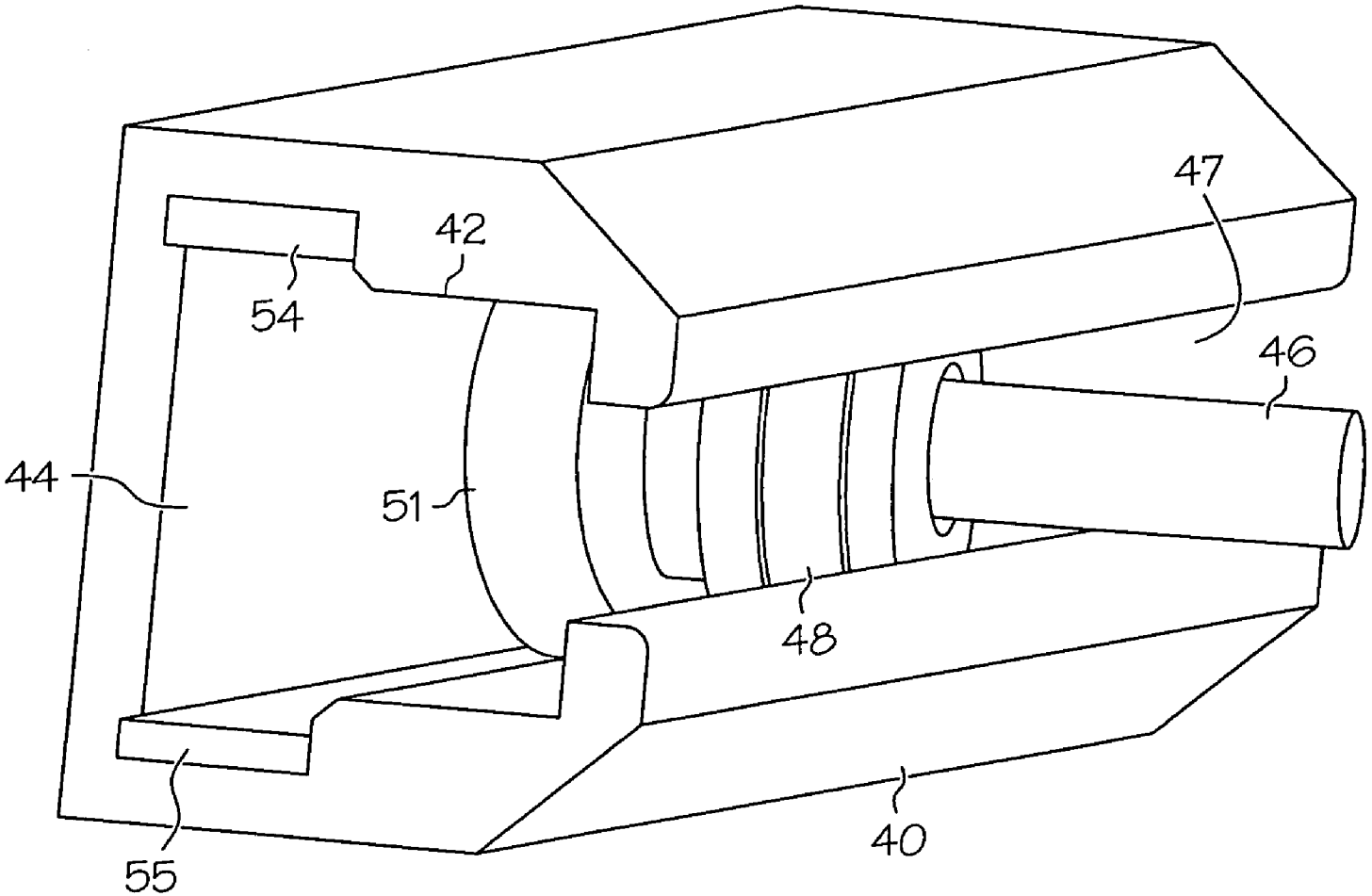
FIG. 7 is an enlarged fragmentary view of the internal rail of another embodiment of the guide rail of the invention.

In FIGS. 4 and 7 the combination of the elongated pin 46, the wheels 48 and the brake plate 50/51, collectively comprise a pin assembly. The pin assembly, along with the hinge 20 and the casing of the support bar, collectively comprise a support bar assembly 14. In one embodiment, the supporting framework of the casing encases or affixes the hinge 20 and the pin 46 therewithin, such that the casing, the hinge and the pin assembly all move together as a single unit. Movement occurs typically when the support bar assembly 14 is in a horizontal position across the stairway; however movement can also occur when the support bar assembly is folded into the vertical position. Regarding the guide rail assembly, the combination of the tubular inner rail 40 fixedly housed within the tubular outer rail 12 collectively comprises the guide rail assembly. The handle 16, with its grips 30, are rotatably connected to the support bar assembly 14 by connector 15, and the support bar assembly 14 including the pin assembly is supported by the guide rail assembly including the tubular outer rail 12 and the tubular inner rail 40 as they move along guide track 13 and pin slot 47.

Figure 8:
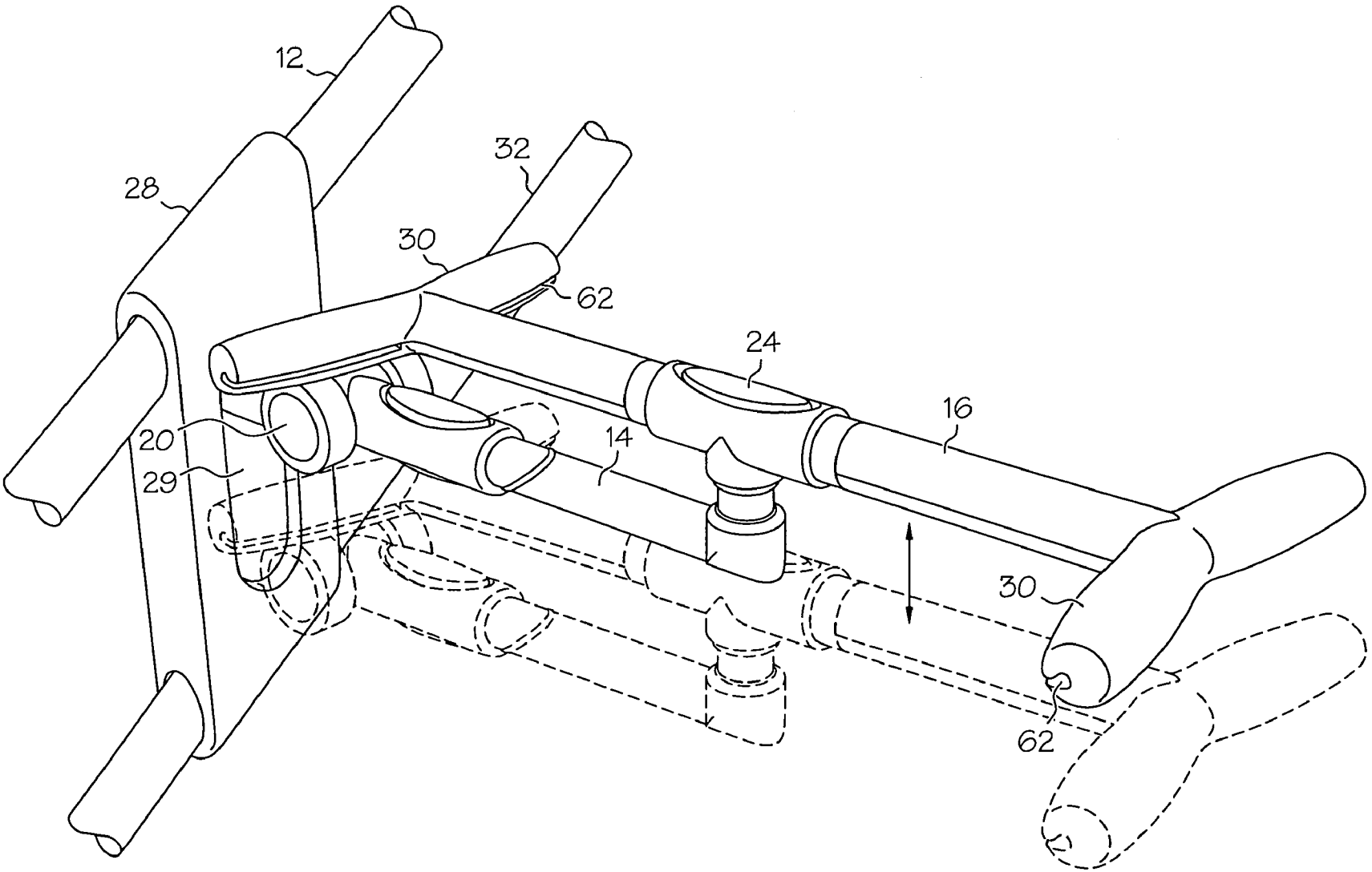
FIG. 8 is a frontal perspective view of a two guide rail embodiment of the invention with the support bar having a sleeve that allows the bar to adjust in height.

Referring now to FIG. 8, another embodiment of the apparatus is illustrated in which there is a first outer rail 12 as well as a second outer rail 32. Both outer rails 12, 32 are part of a separate guide rail assembly, and each guide rail assembly is identical to the other and connected to the other by a lever means 28. As illustrated, the second rail 32 is fixedly positioned below the level of the first rail 12, and the support bar assembly further includes the lever means 28, which is adapted to reversibly adjust the height of the support bar assembly between the height of the first guide rail assembly and the height of the second guide rail assembly. A foramen 29 in the lever means 28 permits this height adjustment. In FIG. 8 the support bar assembly 14 and the handle 16 are shown in both height positions, one in phantom below the other.

The handle side bars 30 are illustrated in FIG. 8 with slots or lumens 62, which will be explained in more detail below. In this embodiment, typically both of the guide rail assemblies 12, 32 also include a pin assembly which is affixed to the lever means 28. The lever means 28 is then affixed to the hinge 20 and the casing of the support bar assembly 14, such that movement of the support bar assembly, including the lever means 28, along the rails by the user will also move both pin assemblies along their respective rails.

In another embodiment (not shown) a second outer rail is fixedly positioned directly across the stairway from the first guide rail assembly. In this embodiment, the support bar assembly is configured to be supported by both the first guide rail assembly and the second outer rail; however the second outer rail need not have an inner rail or any other means to receive a pin assembly, since the support bar casing can merely fittingly move along the surface of the second outer rail.

Figure 9:
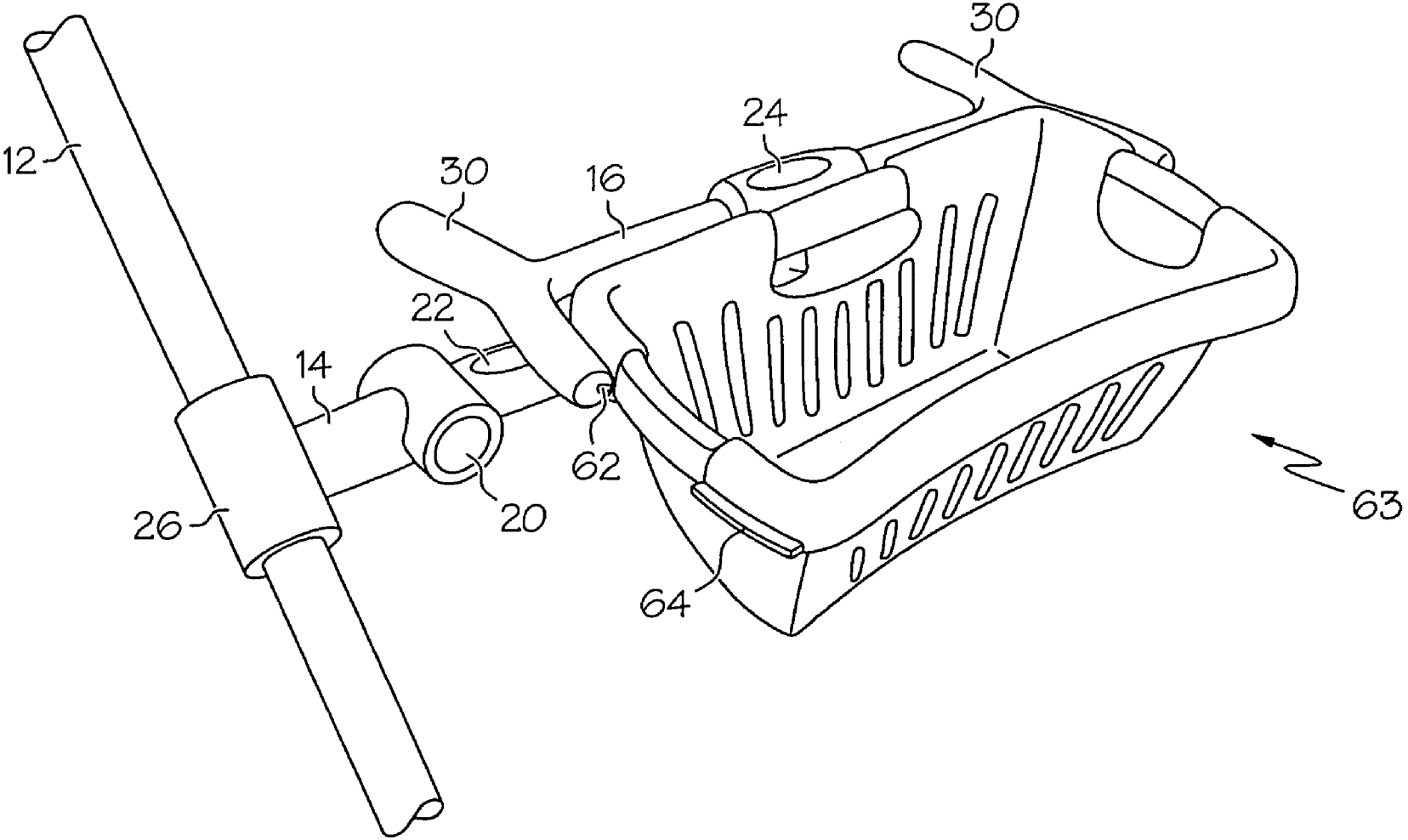
FIG. 9 is a perspective view of the apparatus of FIG. 2 illustrating a laundry basket being held by the handle.

Referring to FIG. 9, each of the side bars 30 of the handle 16 include a lumen 62 into which tabs 64 of a carrying device such as a tray or laundry basket 63 can fit. Typically the handle 16 can be rotated 180° when unlocked, and allows the user to more easily load and unload the carrying device 63. Once the carrying device 63 is loaded by inserting its tabs 64 into the lumen 62 of the side bars 30, the user can unlock the handle 16 via the handle control button 24 and rotate the basket 63 to face away from them as they ascend or descend the stairs. The weight of the basket 63 is supported by the support bar assembly 14, and the user can operate the apparatus to ascend or descend the stairway without having to carry the basket 63 themselves.

To operate the apparatus, the user typically stands on the lower floor up close to the handle and grasps the handle while supporting the upper body on the support bar. With this aid, the user then lifts first one foot and then the other up the first step of the stairway and then moves the support bar assembly along the guide rail assembly. The handle and support bar assembly can be placed into the braking position as needed while moving along the stairway. The user will then repeat this procedure as to each step, stopping at a braking position as needed, until arriving at the top of the stairway. The guide track of the guide rail assembly will continue up past the top of the stairway far enough so that the user is firmly and safely on the upper floor. Once the user reaches the top of the stairs, the support bar assembly can be folded at the hinge and placed in a vertical position along side the top of the stairway until such time as the user wishes to go downstairs.

When the user wishes to descend the stairs, he grasps the handle and allows the support bar assembly to slide down the guide track of the tubular outer rail. At this point, he can put his weight on the handle and support bar assembly and stop at a braking position as needed, moving down the steps until he reaches the bottom of the stairs. The guide track of the guide rail assembly will continue past the stairway sufficiently so that he is firmly on the bottom floor before he folds the support bar into its vertical position until such time as he wants to go back upstairs.

Typical manufacturing methods for the apparatus of the invention can be by casting, injection molding, stamping and extrusion, and the typical materials can be ABS (Acrylonitril-Butadiene-Styrene), nylon, and PBT polyester. As a non-limiting example, the carrying device (laundry basket, tray, etc.) can be made by injection molding with ABS, the wheels in the thrust tracks can be made using nylon, and the internal rail, axle, hinge, and handle can be extrusion molded with PBT polyester. However, the apparatus is not limited by the materials used to manufacture it, such that materials not yet known in the art may likely be used.

The apparatus of the present invention has many advantages over the prior art. For example, the apparatus can bear substantially the entire weight of the elderly or disabled individual, can be folded at the hinge and neatly placed in a vertical position to the side of the stairway when not in use, is light in weight and can easily be moved in a straight line along the entire length of a stairway by a user climbing or descending a stairway, can assist someone who is carrying something such as laundry or groceries up and down stairs by supporting the weight of the carrying device, and is adaptable to any home.

While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art. The invention in its broader aspects is therefore not limited to the specific details, representative apparatus and method, and illustrated examples shown and described. Accordingly, departures may be made from such details without departing from the scope or spirit of the invention.

What is claimed is:

1. An apparatus for assisting a user in walking or carrying items up or down a stairway, the apparatus comprising:

a. a guide rail assembly fixedly positioned along the wall of a stairway and comprising a tubular inner rail fixedly housed within a tubular outer rail, the outer rail including a guide track formed along the length thereof, the inner rail including a pin slot configured to align with the guide track;

b. a support bar assembly configured to be supported by the inner rail and freely moveable along the length of the pin slot, the support bar assembly operable to be placed into a braking position by the user; and c. a handle adapted to be grasped by the user, wherein the handle is rotatably connected to the support bar assembly.

2. The apparatus of claim 1, wherein the support bar assembly is placed into the braking position by the user pushing down on or pulling up on the handle.

3. The apparatus of claim 1, wherein the handle comprises side bars adapted to secure a carrying device, and wherein the side bars include lumens and the carrying device includes tabs configured to fit within the lumens.

4. The apparatus of claim 1, wherein the inner rail of the guide rail assembly further includes a brake track and a thrust track, and wherein the support bar assembly comprises a pin assembly, a hinge and a casing, the pin assembly comprising:

i. at least one wheel comprising an orifice and configured to rotatably move along the thrust track;

ii. a brake plate configured to slidably move within the brake track and operable to pivot within the brake track to place the support bar assembly into the braking position; and iii. an elongated pin comprising a proximal end affixed to the brake plate and a distal end affixed to the hinge and the support bar casing, the pin extending through the guide track, the pin slot and the orifice of the at least one wheel.

5. The apparatus of claim 4, wherein the hinge is operable to allow the user to reversibly move the support bar assembly between a use position and a non-use position, the use position placing the support bar assembly horizontally across the stairway, the non-use position placing the support bar in a vertical position along the side of the stairway.

6. The apparatus of claim 5, wherein the support bar assembly further includes a hinge control button operable to reversibly lock and unlock the hinge.

7. The apparatus of claim 1, wherein the handle comprises a handle control button operable to reversibly lock and unlock rotation of the handle about the support bar assembly.

8. The apparatus of claim 1, wherein the guide rail assembly is a first guide rail assembly, the apparatus further comprising a second guide rail assembly identical to and fixedly positioned along the wall below the level of the first guide rail assembly, and wherein the support bar assembly comprises a lever means adapted to reversibly adjust the height of the support bar assembly between the height of the first guide rail assembly and the height of the second guide rail assembly.

9. The apparatus of claim 1, wherein the guide rail assembly is a first guide rail assembly, the apparatus further comprising a second guide rail assembly comprising a second outer rail fixedly positioned directly across the stairway from the first guide rail assembly, and wherein the support bar assembly is configured to be supported by both guide rail assemblies.

10. An apparatus for assisting a user in walking or carrying items up or down a stairway, the apparatus comprising:

a. a guide rail assembly fixedly positioned along the wall of a stairway and comprising a tubular inner rail fixedly housed within a tubular outer rail, the outer rail including a guide track formed along the length thereof, the inner rail including a brake track, a thrust track, and a pin slot configured to align with the guide track of the outer rail;

b. a support bar assembly configured to be supported by the inner rail and freely moveable along the length of the pin slot, the support bar assembly operable to be placed into a braking position by the user and comprising a pin assembly, a hinge, and a casing, the pin assembly comprising:

i. at least one wheel comprising an orifice and configured to rotatably move along the thrust track;

ii. a brake plate configured to slidably move within the brake track and operable to pivot to a braking position within the brake track; and iii. an elongated pin comprising a proximal end affixed to the brake plate and a distal end affixed to the hinge and the support bar casing, the pin extending through the guide track, the pin slot and the orifice of each wheel; and c. a handle adapted to be grasped by the user, wherein the handle is rotatably connected to the support bar casing.

11. The apparatus of claim 10, wherein the handle comprises side bars adapted to secure a carrying device, the side bars including lumens and the carrying device including tabs configured to fit within the lumens.

12. The apparatus of claim 10, wherein the hinge is operable to allow the user to reversibly move the support bar assembly between a use position and a non-use position, the use position extending the support bar assembly horizontally across the stairway, the non-use position placing the support bar in a vertical position parallel to the wall.

13. The apparatus of claim 12, wherein the support bar assembly further includes a hinge control button operable to reversibly lock and unlock the hinge.

14. The apparatus of claim 10, wherein the handle comprises a handle control button operable to reversibly lock and unlock rotation of the handle about the support bar casing.

15. The apparatus of claim 10, the brake track comprising a gear track, and the brake plate comprising gears configured to engage the gear track and a nub defining the central bottom portion of the brake plate, contact between the nub and the brake track is operable to cause the brake plate to pivot within the brake track, and wherein pivoting of the brake plate is operable to cause the gears to engage the gear track and place the support bar assembly into the braking position.

16. The apparatus of claim 15, wherein contact between the nub and the brake track is caused by the user pushing down on the handle.

17. The apparatus of claim 16, wherein the gears engage the gear rack when the brake plate pivots between about seven degrees to about ten degrees from a horizontal plane.

18. The apparatus of claim 10, the brake track comprising top and bottom elastomeric strips, and the brake plate comprising an elliptical plate configured to pivot within the brake track, wherein pivoting of the elliptical plate is operable to reversibly wedge the brake plate between the elastomeric strips and place the support bar assembly into the braking position.

19. The apparatus of claim 18, wherein pivoting of the elliptical plate is caused by the user pushing down or pulling up on the handle.

20. The apparatus of claim 19, wherein the brake plate becomes reversibly wedged between the elastomeric strips when the brake plate pivots between about seven degrees to about ten degrees from a horizontal plane.

21. The apparatus of claim 10, wherein the guide rail assembly is a first guide rail assembly, the apparatus further comprising a second guide rail assembly identical to and fixedly positioned along the wall below the level of the first guide rail assembly, and wherein the support bar assembly comprises a lever means adapted to reversibly adjust the height of the support bar assembly between the height of the first guide rail assembly and the height of the second guide rail assembly.

22. The apparatus of claim 10, wherein the guide rail assembly is a first guide rail assembly, the apparatus further comprising a second guide rail assembly comprising a second outer rail fixedly positioned directly across the stairway from the first guide rail assembly, and wherein the support bar assembly is configured to be supported by both guide rail assemblies.

* * * * *